US008387291B2

(12) United States Patent
Compeau et al.

(10) Patent No.: US 8,387,291 B2
(45) Date of Patent: Mar. 5, 2013

(54) STEAM IRON COMPRISING A SMOOTHING BRUSH

(75) Inventors: Jean-Louis Compeau, Saint Quentin Fallavier (FR); Denis Paccaud, Lyons (FR); Martin Krebs, Obernburg (DE); Dierk Spatz, Erbach (DE)

(73) Assignee: SEB S.A., Ecully (FR)

( * ) Notice: Subject to any disclaimer, the term of this patent is extended or adjusted under 35 U.S.C. 154(b) by 197 days.

(21) Appl. No.: 12/968,316

(22) Filed: Dec. 15, 2010

(65) Prior Publication Data

US 2011/0146116 A1 Jun. 23, 2011

(30) Foreign Application Priority Data

Dec. 17, 2009 (FR) ..... 09 06122

(51) Int. Cl.
*D06F 75/20* (2006.01)
*D06F 75/36* (2006.01)

(52) U.S. Cl. ..... 38/77.9

(58) Field of Classification Search ..... 38/77.1–77.83, 38/93; 68/222
See application file for complete search history.

(56) References Cited

U.S. PATENT DOCUMENTS

| | | | | | |
|---|---|---|---|---|---|
| 2,217,729 | A | * | 10/1940 | Chancey | 132/227 |
| 2,849,736 | A | * | 9/1958 | Kohle | 401/2 |
| 3,590,504 | A | * | 7/1971 | Davidson | 38/77.1 |
| 3,805,425 | A | * | 4/1974 | Spoida et al. | 38/69 |
| 3,814,898 | A | * | 6/1974 | Levine | 392/404 |
| 5,609,047 | A | * | 3/1997 | Hellman et al. | 68/222 |
| 5,787,614 | A | * | 8/1998 | Stutzer | 38/77.1 |
| 6,009,645 | A | * | 1/2000 | Shimizu et al. | 38/77.5 |
| 6,031,969 | A | * | 2/2000 | Burr et al. | 392/404 |
| 2002/0029498 | A1 | | 3/2002 | Harrison et al. | |
| 2008/0061169 | A1 | | 3/2008 | Copeland | |
| 2010/0043257 | A1 | | 2/2010 | Krebs et al. | |

FOREIGN PATENT DOCUMENTS

FR 2912429 A1 8/2008

* cited by examiner

*Primary Examiner* — Ismael Izaguirre
(74) *Attorney, Agent, or Firm* — The Webb Law Firm

(57) ABSTRACT

A steam iron having a boiling compartment (15) for producing steam and a steam distribution circuit with a smoothing brush (3) including a head (31) equipped with at least one hole (32) for emitting a flow of steam, characterized in that it contains a steam flow acceleration device (4) that generates a puff of air to increase the steam flow rate at the outlet of the smoothing brush (3).

20 Claims, 4 Drawing Sheets

STEAM IRON COMPRISING A SMOOTHING BRUSH

BACKGROUND OF THE INVENTION

1. Field of the Invention

The present invention relates to a steam iron comprising a boiling compartment for producing a steam flow and a steam distribution circuit with a smoothing brush equipped with at least one hole for emitting steam.

2. Brief Description of the Prior Art

French patent application FR 2 912 429 discloses a steam iron comprising a steam production device consisting of a boiling compartment with a heating body and a steam outlet through which steam can freely escape in the direction of a smoothing brush.

Such an appliance offers the advantages of being inexpensive to manufacture and capable of quickly producing a saturating flow of steam that, when combined with a fiber brushing action, allows for a quick smoothing of curtains or clothing hanging vertically on a hanger.

However, such an iron has a boiling compartment that supplies steam at atmospheric pressure, resulting in a low steam flow rate at the outlet of the smoothing brush that is detrimental to the proper penetration of steam into fabrics, particularly for thick clothing. In addition, the low speed of the steam at the outlet of the smoothing brush prevents the proper direction of the steam jet, making it impossible to precisely treat the areas of clothing that are to be smoothed, or to treat clothing arranged horizontally, since the steam naturally has a tendency to rise upwards, whereas the smoothing brush is oriented downwards.

Finally, such irons with boiling compartments operating at atmospheric pressure exhibit the disadvantage of having an irregular flow of steam at the outlet of the smoothing brush, with phases of very low steam flow following phases of high steam flow.

The present invention aims to propose an iron that remedies these disadvantages and is very easily constructed.

SUMMARY OF THE INVENTION

To this end, the object of the invention is a steam iron comprising a boiling compartment for producing a steam flow and a steam distribution circuit with a smoothing brush having a head equipped with at least one hole for emitting steam, characterized in that it comprises a steam flow acceleration device by generating a puff of air that increases the flow rate of the steam at the outlet of the smoothing brush.

According to another characteristic of the invention, the steam flow acceleration device is disposed on the smoothing brush.

According to another characteristic of the invention, the steam flow acceleration device comprises a fan.

According to another characteristic of the invention, the steam flow acceleration device comprises an air circulation conduit with an intake disposed outside of the smoothing brush and a nozzle equipped with an air outlet opening into the flow of steam.

According to another characteristic of the invention, the fan is positioned in proximity to the intake of the air circulation conduit.

According to another characteristic of the invention, the nozzle outlet opens into a steam diffusion compartment that is integrated into the head of the smoothing brush.

According to yet another characteristic of the invention, the nozzle outlet opens upstream from the steam emission hole in such a way that the steam in the diffusion compartment is propelled through the hole of the smoothing head by the flow of air emitted by the nozzle.

According to another characteristic of the invention, the passageway of the nozzle outlet is smaller than or equal to the passageway of the steam emission hole.

According to another characteristic of the invention, the nozzle outlet opens to the exterior of the head, downstream from the steam emission hole.

According to another characteristic of the invention, the distance separating the nozzle outlet from the steam emission hole is less than 1 cm.

According to another characteristic of the invention, the air circulation conduit takes the form of a hose with an intake passageway larger than the air outlet passageway.

According to yet another characteristic of the invention, the air circulation conduit comprises means for heating the air sent through the nozzle.

According to yet another characteristic of the invention, the steam flow acceleration device comprises means for diffusing an additive into the flow of steam.

BRIEF DESCRIPTION OF THE DRAWINGS

The objectives, appearance and advantages of the present invention will be better understood based on the description given hereafter of a particular embodiment of the invention and variations thereof, which are presented as non-exhaustive examples, with reference to the attached drawings, wherein.

DETAILED DESCRIPTION OF THE INVENTION

Only the elements necessary for understanding the invention are shown. To facilitate the reading of the drawings, the same elements bear the same references from one figure to another.

Figure 1:
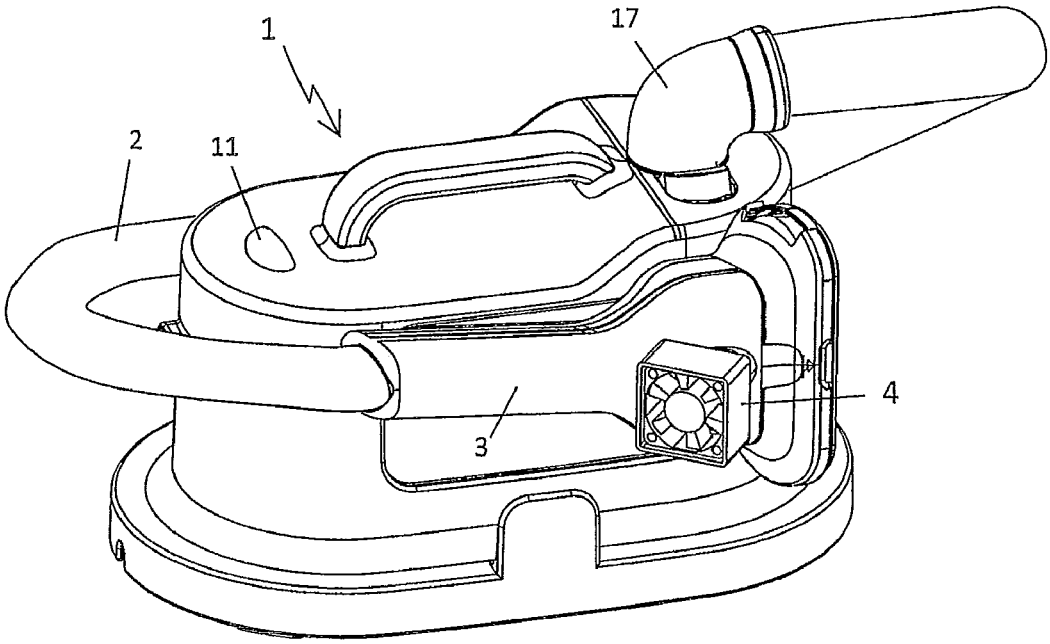
FIG. 1 is a perspective view of an iron according to a particular embodiment of the invention.

FIG. 1 shows a steam iron comprising a base 1 for generating steam connected by a flexible conduit 2 to a smoothing brush 3, said base 1 being similar to that described in greater detail in patent application FR 2 912 429.

Figure 2:
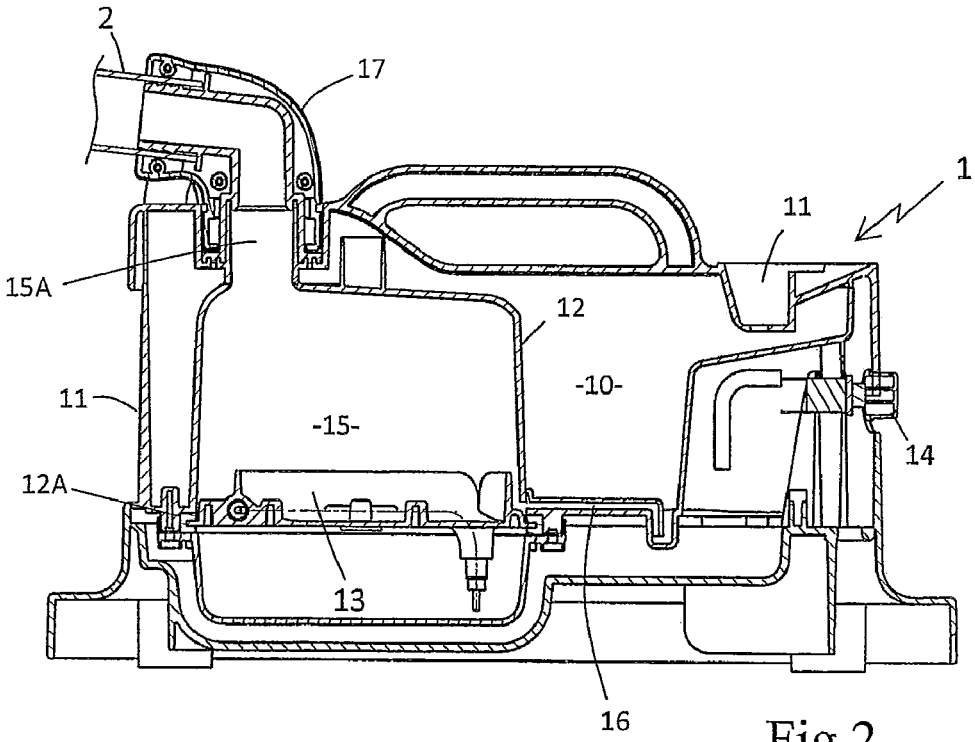
FIG. 2 is a longitudinal sectional view of the appliance presented in FIG. 1.

In accordance with FIG. 2, the base 1 comprises an top side with a filling aperture 11 opening into a water tank 10, said tank 10 containing a boiling compartment 15 of limited volume in the shape of a bell 12 projecting into the bottom of the tank 10 and having a lower end resting against a seal 12A extending around a heating body 13. The heating body 13, which is advantageously made of aluminum, encloses a 1500 watt U-shaped resistor traditionally powered by a circuit with a thermostat that is not visible in the figures and a switch 14 to interrupt the electrical supply to the resistor.

The boiling compartment 15 thus created is directly supplied with water from the tank 10 by supply channels 16 enabling the progressive transfer, through gravity, of water from the tank 10 to the boiling compartment 15.

The top of the bell 12 comprises a steam outlet 15A that is connected, by means of a rotary connector 17, directly to the flexible supply conduit 2 of the smoothing brush 3 in such a way that the steam produced by the boiling compartment 15 can freely escape to the smoothing brush 3 through the flexible conduit 2 without being diffused into the tank 10.

The flexible conduit 2 is preferably made of an EPDM (Ethylene Propylene Diene Monomer) material in order to obtain good thermal insulation, thus limiting the cooling of the steam during its passage through the flexible conduit 2, which preferably has a length of more than 1.50 m for improved ergonomic performance.

Figure 3:
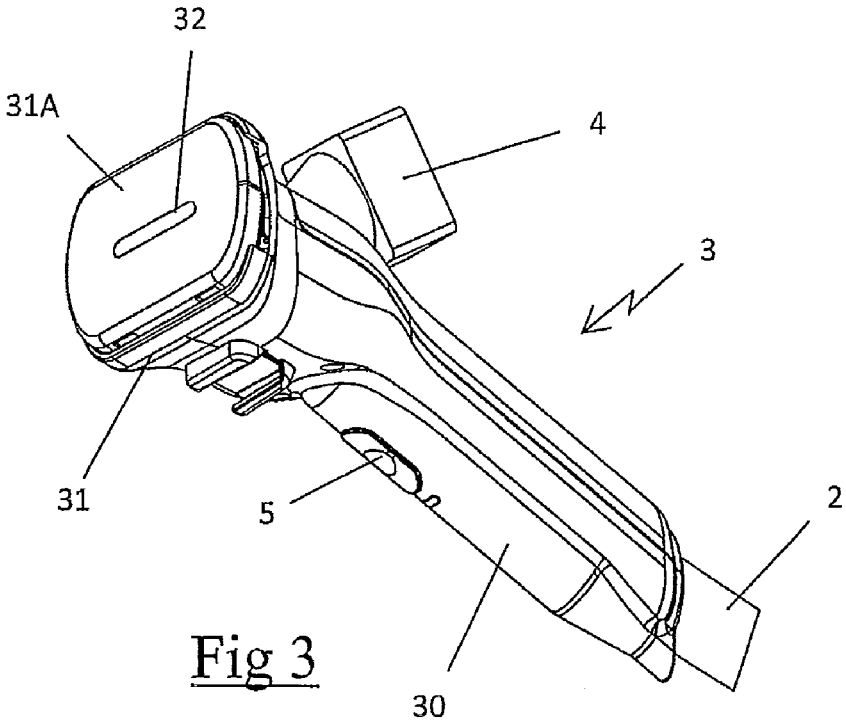
FIGS. 3 and 4 are perspective views of the smoothing brush that equips the appliance presented in FIG. 1.
Figure 4:
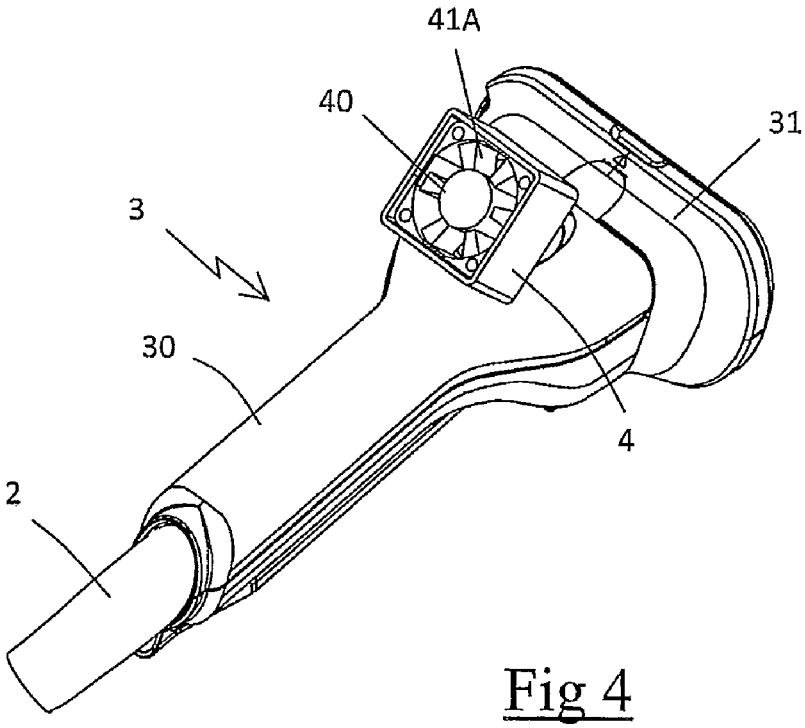
Figure 5:
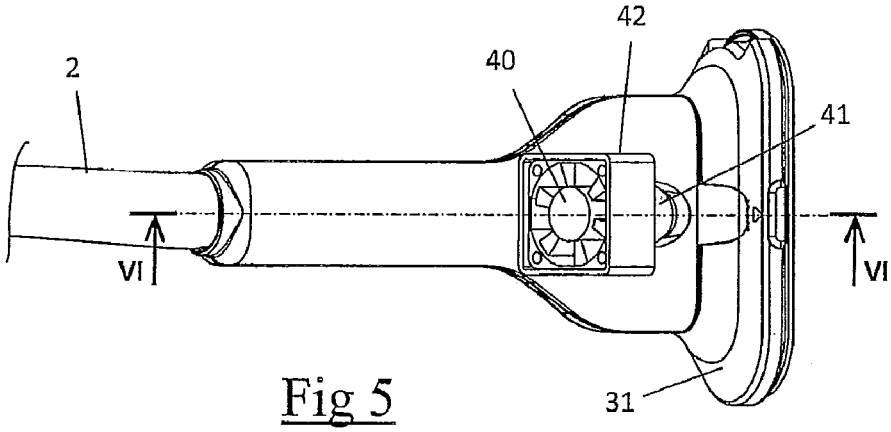
FIG. 5 is a top view of the smoothing brush presented in FIGS. 3 and 4.

In accordance with FIG. 3, the smoothing brush 3 comprises a body with a cylindrical grip 30 positioned in the extension of a head 31 for diffusing the steam, said head 31 having a flat front surface 31A equipped with a steam emission hole 32 in the shape of an oblong slit.

More particularly, according to the invention and in accordance with FIGS. 4 to 8, the smoothing brush 3 comprises a steam flow acceleration device 4 by generating a puff of air to increase the steam flow rate at the outlet of the smoothing brush 3.

This steam flow acceleration device 4 has a fan 40 controlled by a button 5 on the handle 30, said fan 40 blowing through a hose 41 that passes through the body of the smoothing brush 3 and comprises an air intake 41A positioned on the exterior of the smoothing brush 3 as well as an air ejection nozzle 43 opening into the smoothing head 3.

As an example, the fan 40 consists of an axial fan that traditionally has a propeller powered by an electric motor integrated into the propeller boss that delivers 1 watt of power via cables (not shown on the figures), which extend along the flexible conduit 2 to the base 1.

Figure 6:
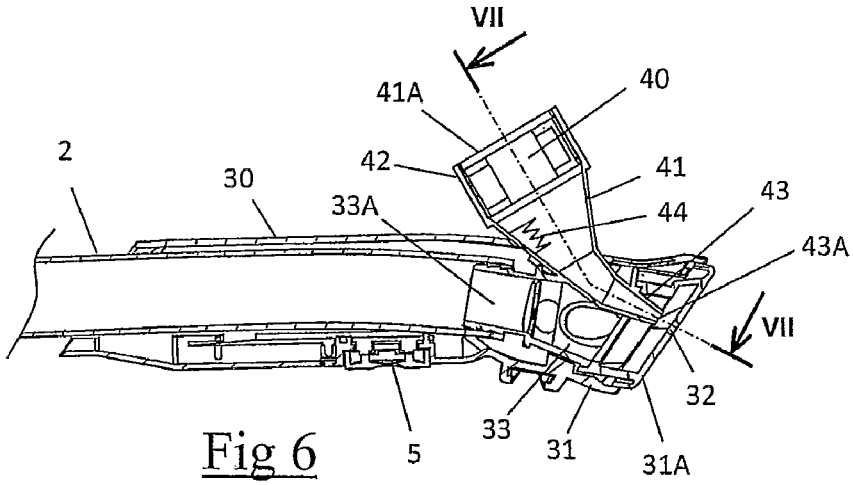
FIG. 6 is a transverse sectional view along the line VI-VI presented in FIG. 5.
Figure 7:
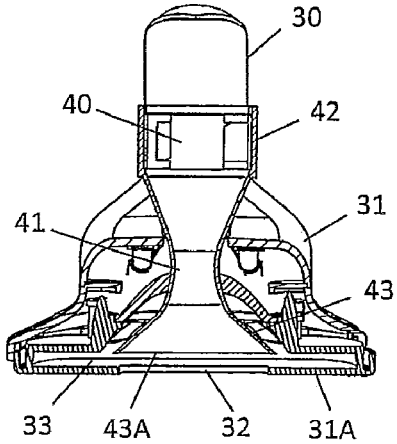
FIG. 7 is a transverse sectional view along the line VII-VII presented in FIG. 6.
Figure 8:
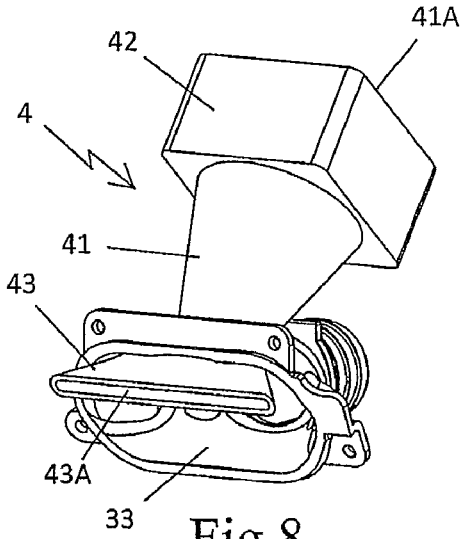
FIG. 8 is a perspective view of the component of the smoothing brush that integrates the steam flow acceleration device, shown alone.

In accordance with FIGS. 6 and 7, the fan 40 is preferably disposed in a housing 42 that extends outside the body of the smoothing brush 3 at the end of the hose 41 with the air intake 41A. The hose 41 has a convergent shape from this end of the hose 41 with the air intake 41A to a second end with the air ejection nozzle 43, said nozzle 43 having a smaller passageway causing the flow of air entering through the intake 41A to accelerate through the hose 41 and exit at a high rate at the outlet of the nozzle 43.

The nozzle 43 thus forms an air ejector opening into a steam diffusion compartment 33 disposed upstream from the front surface 31A of the smoothing head, said diffusion compartment 33 receiving steam through an aperture 33A connected to be flexible conduit 2 by means of a coupling sleeve, and having a divergent shape from the intake 33A to the front surface 31A of the smoothing head.

The outlet 43A of the nozzle 43 is preferably aligned with the steam diffusion hole 32, said hole 32 having a passageway that is slightly greater than the passageway of the outlet 43A of the nozzle 43 such that the jet of air emitted by the nozzle 43 easily forces the flow of steam through the steam diffusion hole 32 by means of a momentum exchange.

The resulting appliance comprises a smoothing brush 3 wherein the flow of saturating steam produced by the boiling compartment 15 can be accelerated on demand by pressing on the control button 5, which increases the speed of the steam jet at the outlet of the smoothing brush 3. This improves steam diffusion and regulates the flow of steam at the outlet of the appliance's smoothing brush 3. In fact, the applicant realized that by improving steam diffusion, the use of such a steam flow acceleration device eliminated the steam hole phenomena commonly encountered with this type of appliance.

The increase in the steam flow rate at the outlet of the smoothing brush 3 also enables a more precise application of the steam jet and particularly results in a longer and more directed steam jet, even when the smoothing brush 3 is oriented downwards, thereby allowing the treatment of horizontally-arranged textiles.

Finally, this type of steam flow acceleration device 4 has the advantage of comprising a fan 40 disposed outside of the flow of steam to optimize its service life, away from excessive heat and humidity.

In a variation of the embodiment, the hose 41 of the steam flow acceleration device 4 may also comprise an electric resistor 44, which is schematically illustrated in FIG. 6, positioned downstream from the fan 40.

Such a resistor 44 heats the flow of air emitted by the nozzle 43 which has the advantage of limiting any steam condensation that may appear in the smoothing brush 3. In addition, the flow of hot air thus produced by the steam acceleration device may advantageously be used by itself, that is, without producing steam, in order to dry clothing using only the flow of hot air diffused by the nozzle 43 through the smoothing brush 3.

Figure 9:
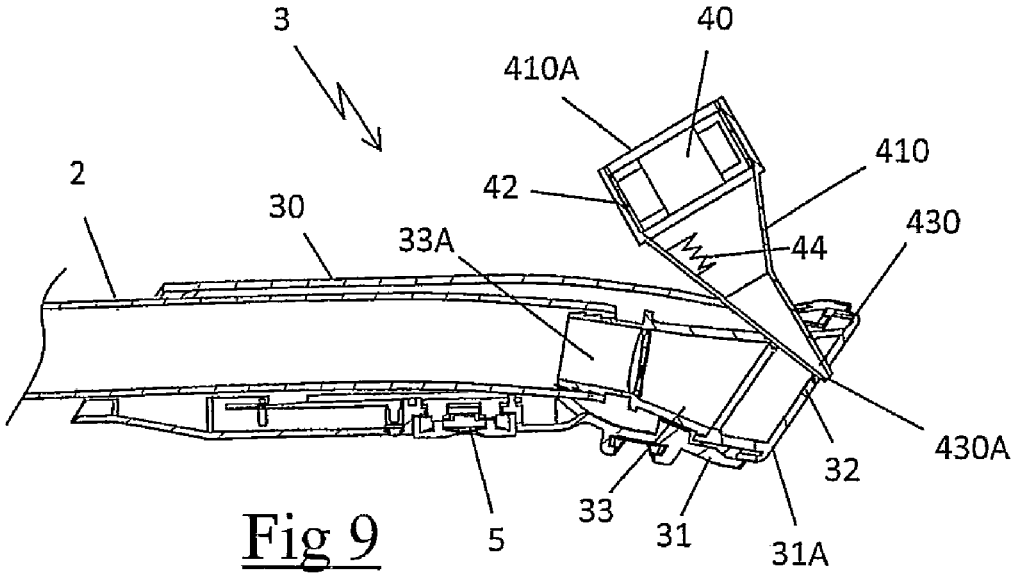
FIG. 9 is a transverse sectional view of a variation of the embodiment of the smoothing brush of FIG. 6.

In a variation of the embodiment illustrated in FIG. 9, the smoothing brush 3 could comprise a hose 410 with an air intake 410A and a nozzle 430 equipped with an outlet 430A opening to the exterior of the smoothing brush 3 near the steam emission hole 32, such that the flow of air emitted from the nozzle 430 converges with the flow of steam emitted from the steam diffusion hole 32 and accelerates the latter by means of a momentum change.

Figure 10:
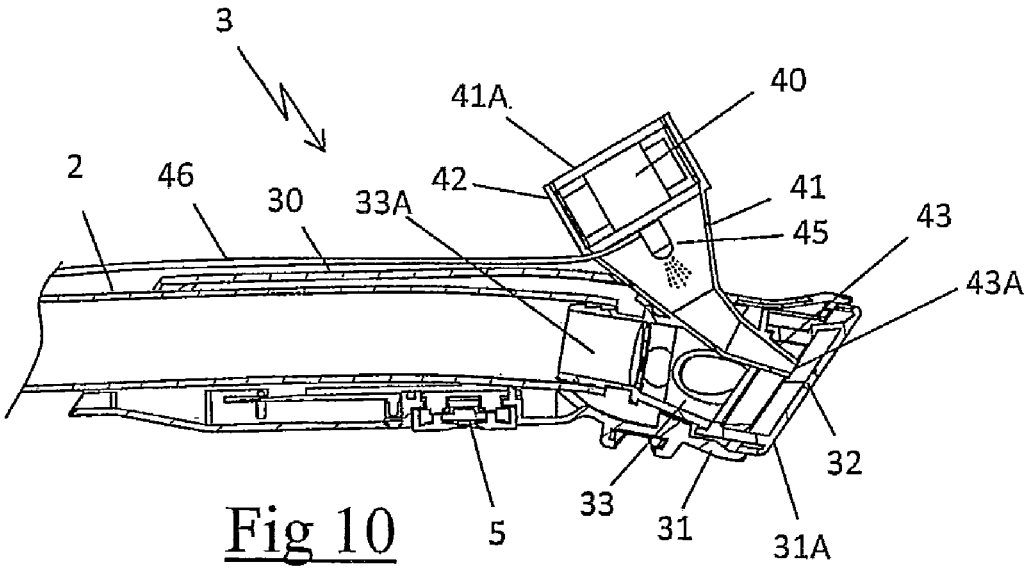
FIG. 10 is a transverse sectional view of another embodiment of the smoothing brush presented in FIG. 6.

In another variation of the embodiment illustrated in FIG. 10, the smoothing brush 3 of FIG. 6 comprises a diffuser 45 connected by a tube 46 to an additive tank (not shown in the figures) integrated into the base 1. The additive diffuser 45 is advantageously positioned in the hose 41 of the steam flow acceleration device and allows the diffusion of an additive mist into the flow of air produced by the fan 40. This additive mist is produced by means of an electric pump integrated into the base 1 and controlled by a button on the smoothing brush 3, (not shown in the figures) with the pump sending the liquid additive under pressure to the diffuser 45.

Such a device therefore has the advantage of allowing the diffusion of an additive into the flow of steam produced by the smoothing brush 3, with the droplets emitted from the additive diffuser 45 being transported by the flow of air to the outlet 43A of the nozzle 43, then mixed with the flow of steam being diffused through the steam diffusion hole 32.

The invention is in no way limited to the embodiments described and illustrated herein, which were provided solely for the purpose of example. Modifications are possible, particularly in terms of the constitution of the various elements or by substituting equivalent techniques, without in any way exceeding the scope of protection of the invention.

Thus, in a variation of embodiment not shown, the fan used could be an axial flow or radial centrifuge fan, which would have the advantage of being less cumbersome.

The invention claimed is:

1. Steam iron comprising a boiling compartment for producing a steam flow and a steam distribution circuit with a smoothing brush coupled to the boiling compartment via a flexible conduit, the smoothing brush comprising a head equipped with at least one hole for emitting steam, wherein the steam iron comprises a steam flow acceleration device that generates a puff of air, thereby increasing the steam flow rate at the outlet of the smoothing brush.

2. Steam iron according to claim 1, wherein the said steam flow acceleration device is disposed on the smoothing brush.

3. Steam iron according to claim 2, wherein the steam flow acceleration device comprises a fan.

4. Steam iron according to claim 1, wherein the steam flow acceleration device comprises a fan.

5. Steam iron according to claim 4, wherein the steam flow acceleration device comprises an air circulation conduit with an intake positioned outside of the smoothing brush and a nozzle equipped with an air outlet opening into the flow of steam.

6. Steam iron according to claim 5, wherein the fan is positioned near the intake.

7. Steam iron according to claim 6, wherein the outlet of the nozzle opens into a steam diffusion compartment integrated into the head of the smoothing brush.

8. Steam iron according to claim 6, wherein the outlet of the nozzle opens to the outside of the head, downstream from the steam emission hole.

9. Steam iron according to claim 6, wherein the distance separating the outlet of the nozzle from the steam emission hole is less than 1 cm.

10. Steam iron according to claim 6, wherein the air circulation conduit is in the form of a hose whose passageway at the intake is greater than the passageway at the air outlet.

11. Steam iron according to claim 5, wherein the outlet of the nozzle opens into a steam diffusion compartment integrated into the head of the smoothing brush.

12. Steam iron according to claim 11, wherein the air circulation conduit comprises means for heating the air sent through the nozzle.

13. Steam iron according to claim 11, wherein the outlet of the nozzle opens upstream from the steam emission hole so that the steam in the diffusion compartment is propelled through the hole of the smoothing head by the flow of air emitted by the nozzle.

14. Steam iron according to claim 13, wherein the passageway of the outlet of the nozzle is smaller than or equal to the passageway of the steam emission hole.

15. Steam iron according to claim 5, wherein the outlet of the nozzle opens to the outside of the head, downstream from the steam emission hole.

16. Steam iron according to claim 5, wherein the distance separating the outlet of the nozzle from the steam emission hole is less than 1 cm.

17. Steam iron according to claim 5, wherein the air circulation conduit is in the form of a hose whose passageway at the intake is greater than the passageway at the air outlet.

18. Steam iron according to claim 5, wherein the air circulation conduit comprises means for heating the air sent through the nozzle.

19. Steam iron according to claim 5, wherein the steam flow acceleration device comprises means for diffusing an additive in the flow of steam.

20. Steam iron according to claim 1, wherein the steam flow acceleration device comprises means for diffusing an additive in the flow of steam.

* * * * *

UNITED STATES PATENT AND TRADEMARK OFFICE

CERTIFICATE OF CORRECTION

PATENT NO. : 8,387,291 B2
APPLICATION NO. : 12/968316
DATED : March 5, 2013
INVENTOR(S) : Jean-Louis Compeau et al.

It is certified that error appears in the above-identified patent and that said Letters Patent is hereby corrected as shown below:

On the Title Page:

Item (75) Inventors, Line 2, delete "Lyons" and insert -- Lyon --

Signed and Sealed this
Ninth Day of July, 2013

Teresa Stanek Rea
*Acting Director of the United States Patent and Trademark Office*